US005980292A

United States Patent [19]

Rothenberger et al.

[11] Patent Number: 5,980,292

[45] Date of Patent: Nov. 9, 1999

[54] CARD EDGE CONNECTOR

[75] Inventors: Richard Ellis Rothenberger, Bainbridge; Kimberly Ann Wright, Felton, both of Pa.

[73] Assignee: The Whitaker Corporation, Wilmington, Del.

[21] Appl. No.: 08/940,717

[22] Filed: Sep. 30, 1997

Related U.S. Application Data

[60] Provisional application No. 60/046,756, May 16, 1997.

[51] Int. Cl.[6] ..... H01R 13/62

[52] U.S. Cl. ..... 439/260

[58] Field of Search ..... 439/260, 261, 439/725, 263, 635, 267, 931, 637

[56] References Cited

U.S. PATENT DOCUMENTS 3,665,370 5/1972 Hartmann ..... 439/260

5,679,018 10/1997 Lopata et al. ..... 439/260

5,795,171 8/1998 Bernardini ..... 439/260

*Primary Examiner*—Lincoln Donovan

*Assistant Examiner*—Eugene G. Byrd

[57] ABSTRACT

The invention is directed to an electrical connector having a first housing to be mounted onto a circuit board. A contact housing is hingably mounted to the first housing. The contact housing has a plurality of contacts mounted therein. The contact housing and the contacts form a board receiving area to receive a second circuit board therein. The contact housing is rotatable from a first position in which the contacts do not engage the second circuit board when it is received within the board receiving area and a second position in which the contacts engage the second circuit board when it is within the board receiving area.

6 Claims, 9 Drawing Sheets

CARD EDGE CONNECTOR

This application claims the benefit of U.S. Provisional Application No. 60/046,756, filed May 16, 1997.

FIELD OF THE INVENTION

The invention is directed towards an assembly for connecting a cable with a circuit board in a separable manner using a card edge connector.

BACKGROUND OF THE INVENTION

What is needed is a connector assembly for connecting a cable to a printed circuit board. The connection from the cable must provide a sealed housing, that is, one that is capable of being submersed entirely in chemical liquids without ensuing damage to the electrical components located therein. And the connection to the circuit board must be provided by a zero insertion force connector.

SUMMARY OF THE INVENTION

The invention is directed to an electrical connector having a first housing to be mounted onto a circuit board. A contact housing is hingably mounted to the first housing. The contact housing has a plurality of contacts mounted therein. The contact housing and the contacts form a board receiving area to receive a second circuit board therein. The contact housing is rotatable from a first position in which the contacts do not engage the second circuit board when it is received within the board receiving area and a second position in which the contacts engage the second circuit board when it is within the board receiving area.

The invention is further directed to an electrical connector assembly having a receptacle connector with a housing and a rotatable contact housing having a plurality of contacts mounted therein. The contact housing has a first position in which the contacts are out of engagement with a mating connector receiving area and a second position wherein the contacts are in engagement with the mating connector receiving area. The contact housing has a first engagement area. A mating plug connector has a circuit board to be received within the mating connector receiving area when mated with the receptacle connector. The plug housing has a second engagement area thereon. Whereby upon engagement of the second engagement area on the plug connector with the first engagement area on the receptacle connector, the contact housing is moved from the first position to the second position.

BRIEF DESCRIPTION OF THE DRAWINGS

An embodiment of the present invention will now described with reference to the accompanying drawings, in which.

DETAILED DESCRIPTION OF AN EMBODIMENT OF THE INVENTION

Figure 1:
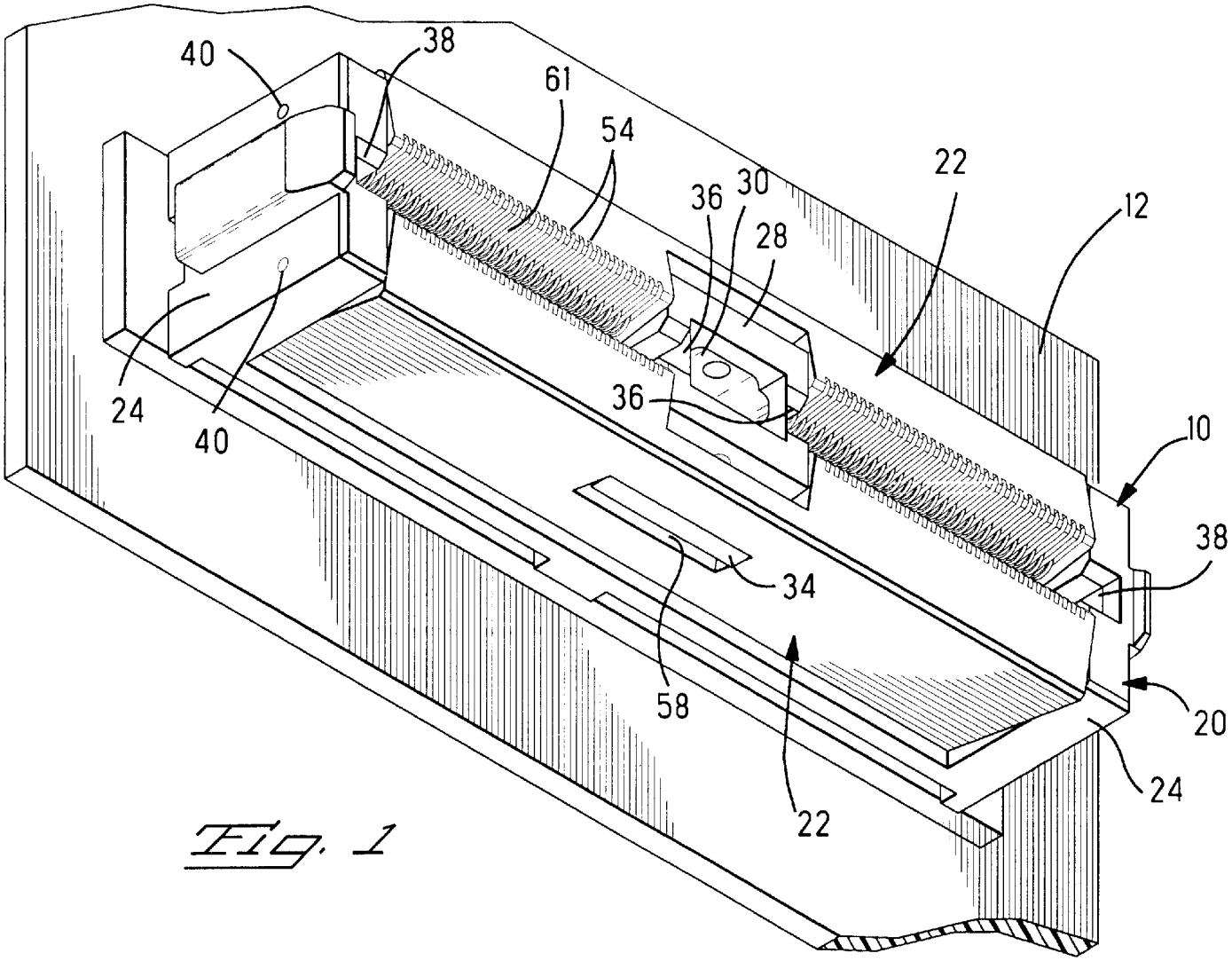
FIG. 1 is an isometric view of the receptacle connector of the present invention mounted to a circuit board.

FIG. 1 shows a receptacle connector 10 mounted onto a circuit board 12. The electrical connector 10 and the circuit board 12 will typically be installed within a piece of electrical equipment or apparatus, wherein the receptacle connector 10 is exposed for mating with the mating plug connector 100, as will be described hereinafter with reference to FIG. 6

Figure 2:
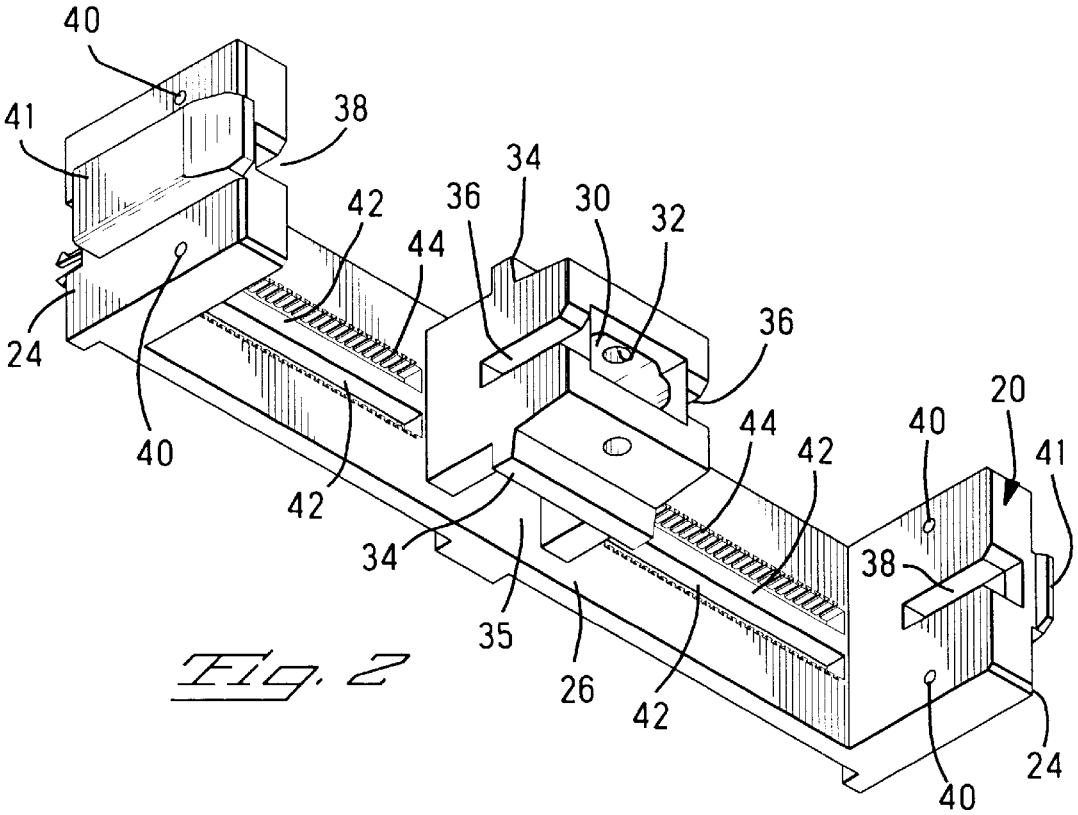
FIG. 2 is an isometric view of the housing.

The receptacle connector 10 includes a main housing 20 and two hingeable contact housings 22 mounted along either side of the main housing 20. The main housing 20 has two end walls 24 extending from the central base 26, see FIG. 2. Along the central portion of the main housing 20 extends central member 28. Central member 28 has a recess 30 extending from the top through the interior of the central member 28. Along sides of the recess 30 are indentations 32. Along either outer side of the central member 28 are protrusions 34. Below each of the protrusions 34 is an opening 35 which is in communication with recess 30. Along inner edges of the central member 28 and the end walls 24 are board receiving slots 36, 38. End walls 24 have pin holes 40 extending therethrough for receiving hinge pins therein. The end walls 24 have polarizing features 41 which ensure that the receptacle connector 10 is correctly aligned with the mating plug connector 100.

Along the base 26 are slots 42. Each of the slots have a plurality of alignment slots 44 along one side thereof. The alignment slots 44 receive the tails 73, (see FIG. 4) 73' (see FIG. 5) of the contacts 70, 70, respectively, and ensure proper alignment and secure mounting of the contacts in the base 26.

The receptacle connector 10 may also have board hold downs or board locks to ensure that the connector remains attached to the circuit board 12. These hold downs are well known in the art and will not be described further herein.

Figure 3:
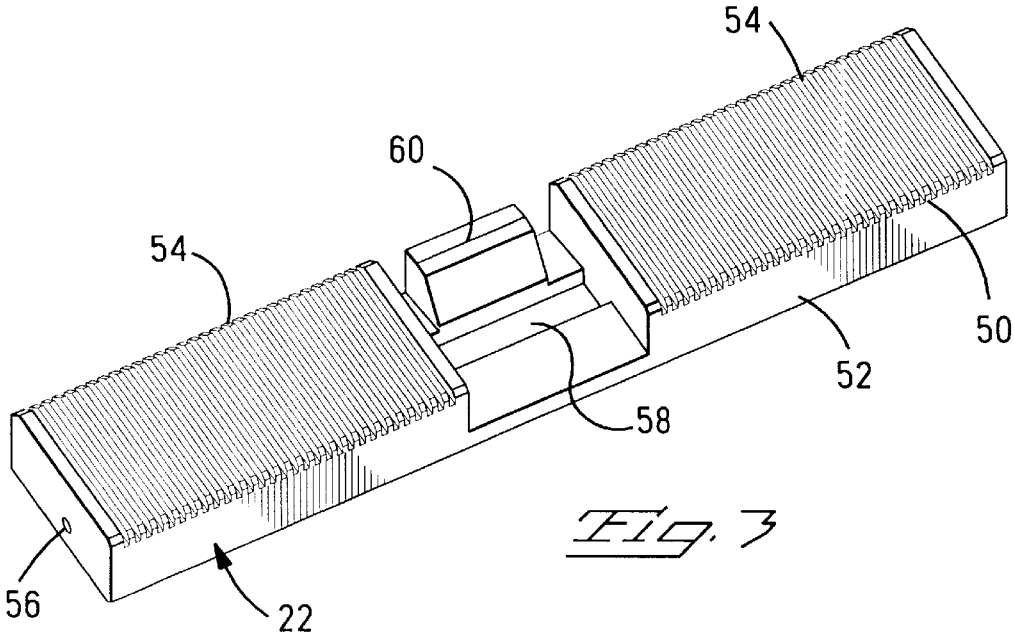
FIG. 3 is an isometric view of the hingeable contact housing.

FIG. 3 shows an isometric view of the hingeable contact housing 22. The housing 22 has a contact face 50 and a rear face 52. The contact face 50 has a series of contact slots 54 to receive the contacts 70, 70' therein. Along either end of the contact housing 22 are hinge holes 56 designed to receive hinge pins therein. The housing 22 has an opening 58 to receive protrusion 34 therethrough. Adjacent to opening 58 is embossment 60. Embossment 60 is in communication with opening 35 when the contact housing 22 is assembled to the main housing 20.

When the receptacle connector 10 is assembled, as shown in FIG. 1, two hingeable contact housings 22 are received along either side of the main housing 20. Four hinge pins are inserted into holes 40 and are also inserted into holes 56 (see FIG. 3) on the ends of the contact housing 22 thereby rotatably securing the contact housing 22 to the main housing 20. The contact housing 22 is free to rotate about the hinge pin to a certain degree. The contacts 70, 70' are received along an inner side of the receptacle contact 10 within the individual contact slots 54, forming two board receiving areas 61 therebetween. The contact housings 22 and the board receiving slots 36, 38 define two board receiving areas 61 into which two individual boards 104 from the mating plug connector 100 can be inserted, the slots 36, 38 serve to align the mating circuit boards 104 (see FIG. 6)

Prior to insertion of the mating board 104 within the board receiving area 61, the contact housings 22 are pivoted outwardly such that their tops, and therefore the contact areas 72, 72' of the contacts 70, 70', are pivoted away from each other, as is shown in FIG. 1. Therefore, upon insertion of mating board, there will be zero insertion force (ZIF) during mating because the mating connector will not engage the contacts during the mating process.

Figure 4:
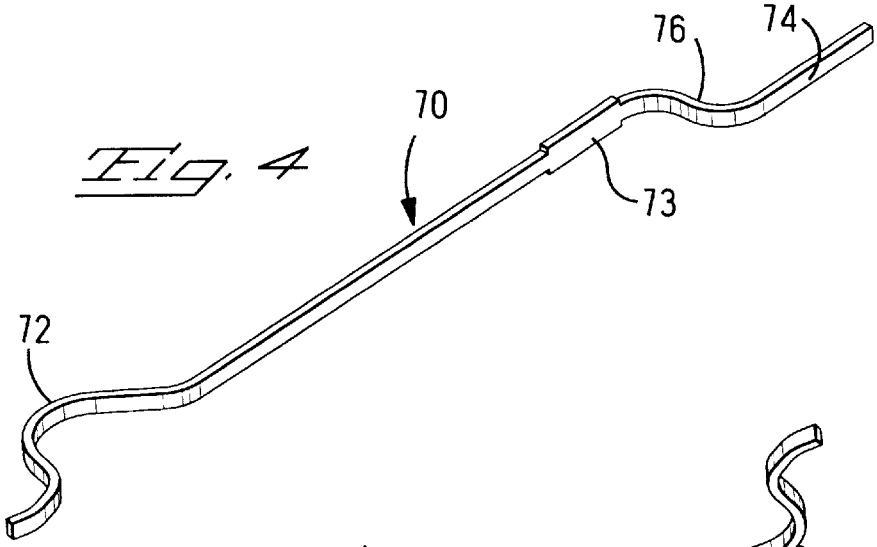
FIG. 4 is an isometric view of one of the contacts used in the present invention.
Figure 5:
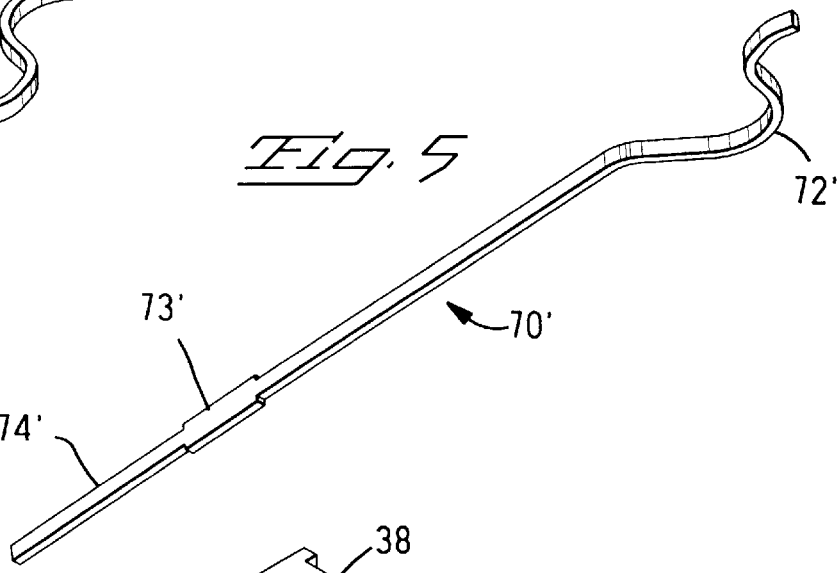
FIG. 5 is an isometric view of the other contact used in the present invention.

FIGS. 4 and 5 show two contacts 70, 70' to be used in the electrical connector 10. The contacts 70, 70' are essentially identical in that they both have contact areas 72, 72' which provide resiliency for contacting with the mating contact pad on the mating circuit board 104 and solder tails 74, 74' which will be received within holes on the circuit board 12. The difference between the contact 70 shown in FIG. 4 and the contact 70' in FIG. 5 is that the contact 70 has a jog 76 between the central portion of the contact and the solder tail 74. This jog is not present in the contact 70' shown in FIG. 5.

When the contacts 70, 70' are installed within the electrical connector 10 they will be alternated between contact 70 and contact 70' so that the solder tails 74 are received in staggered holes on the circuit board 12, not shown. This allows for a higher density of electrical contacts 70, 70' within the electrical connector 10.

The solder tails 74, 74' are aligned in slots 44. The wider portions 73, 73' of the contacts 70, 70' are press fit into the slots 44 and secured therein so that the contact areas 72, 72' are disposed towards the top of the contact housing 22. The contacts 70, 70' are also aligned in contact slots 54 on the contact housing 22. The contacts are alternated so that one contact 70 is next to the other contact 70', see FIG. 11. When the contact housing 22 is rotated within the main housing 20, the contacts 70, 70' are flexible enough to allow the movement of the contact areas 72, 72' without breaking the solder connection between the solder tails 74, 74' and the circuit board 12.

Figure 6:
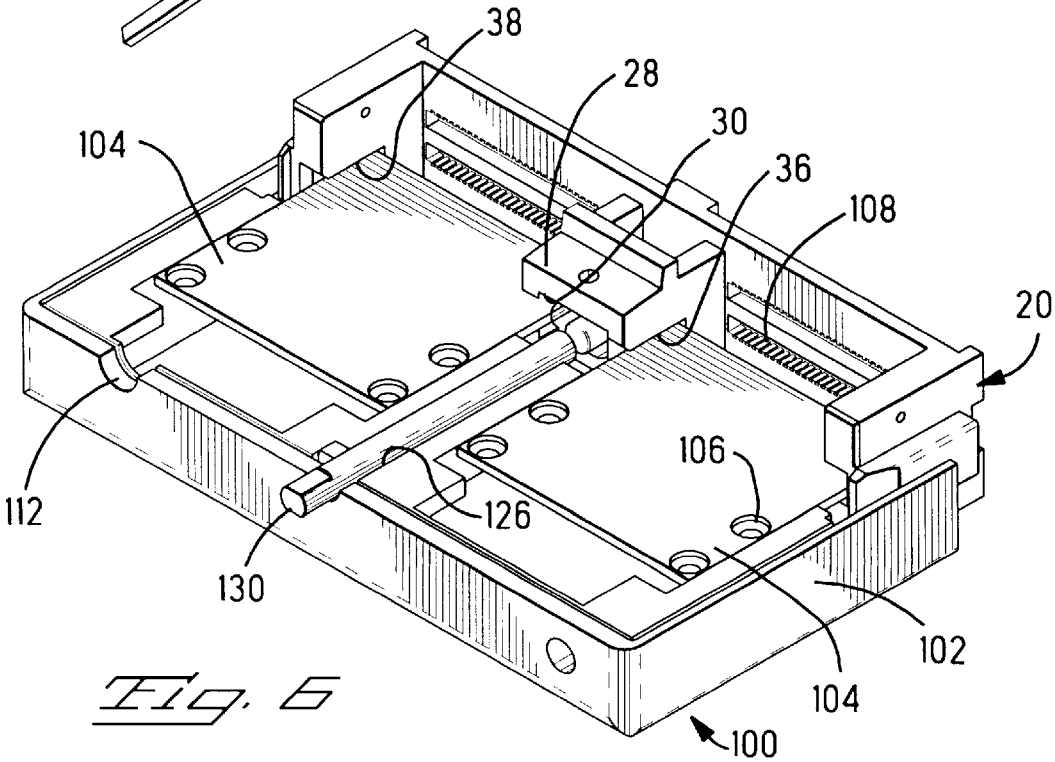
FIG. 6 is an isometric view of a portion of the plug housing of the present invention.

FIG. 6 shows an inside view of the plug connector 100, partially assembled, of the present invention. FIG. 6 also shows the main housing 20 of the receptacle connector 10 in the approximate position that it would be in when the plug connector 100 and the receptacle connector 10 were mated. The receptacle connector 10 is shown without the contacts and the hinge housing for clarity. The plug connector 100 includes two metal shells 102, only one of which is shown in FIG. 6. When assembled, the metal shells 102 will completely surround the circuit boards 104 which are mounted within the shells 102. The circuit boards 104 have securing holes 106 for securing the boards 104 to the shells 102. The circuit boards have contact pads 108 which extend from the front edge of the circuit board 104, along the mating face 110 (see FIG. 7) of the plug connector 100, to mate with the receptacle connector 10. The circuit boards 104 may have a plurality of electrical components, not shown, mounted thereon, depending on the specific application needed for the plug connector. At least one of the shells 102 has a cable hole 112 through which the cable, not shown, will extend. The cable will extend into the plug connector 100 through the hole 112 and will be mated or secured to the circuit boards 104 either by solder connections or by a separable electrical connector thereby forming an electrical connection with the circuit boards 104.

The metal shells 102 completely surround the circuit boards 104 thereby providing EMI control for the circuit boards 104. Furthermore, the shells 102 provide an interior cavity for the circuit boards 104 which allows the cavity to be sealed from the environment. When assembled, the shells 102 can be filled with a plastic foam, potting material, or some other sealing substance to protect the interior of the plug connector 100 from the environment. If the proper sealant is used, the connector 100 may even be immersed in water or other solvents without doing damage to the interior components thereby allowing the connector to be thoroughly cleaned.

Figure 7:
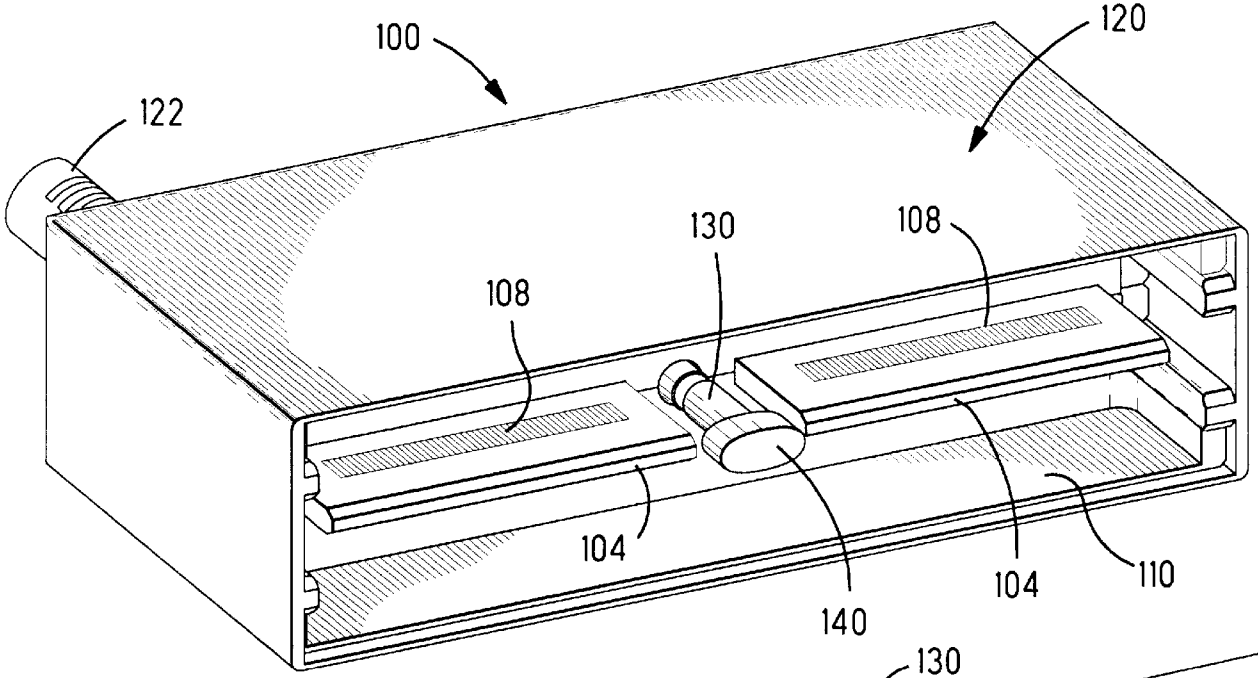
FIG. 7 is an isometric view of the plug housing.

FIG. 7 is an isometric view of the plug connector 100 showing the contact pads 108 on the circuit boards 104 in the mating face 110 of the plug connector 100 to be mated with the receptacle connector 10. The plug connector 100 is shown having a cover 120 which is made of a dielectric material and surrounds the plug connector 100 to protect the connector. The cover 120 provides a strain relief 122 for the cable, not shown, exiting from an end of the plug connector 100. The strain relief 122 is aligned with the cable hole 112 on the shell 102.

Figure 8:
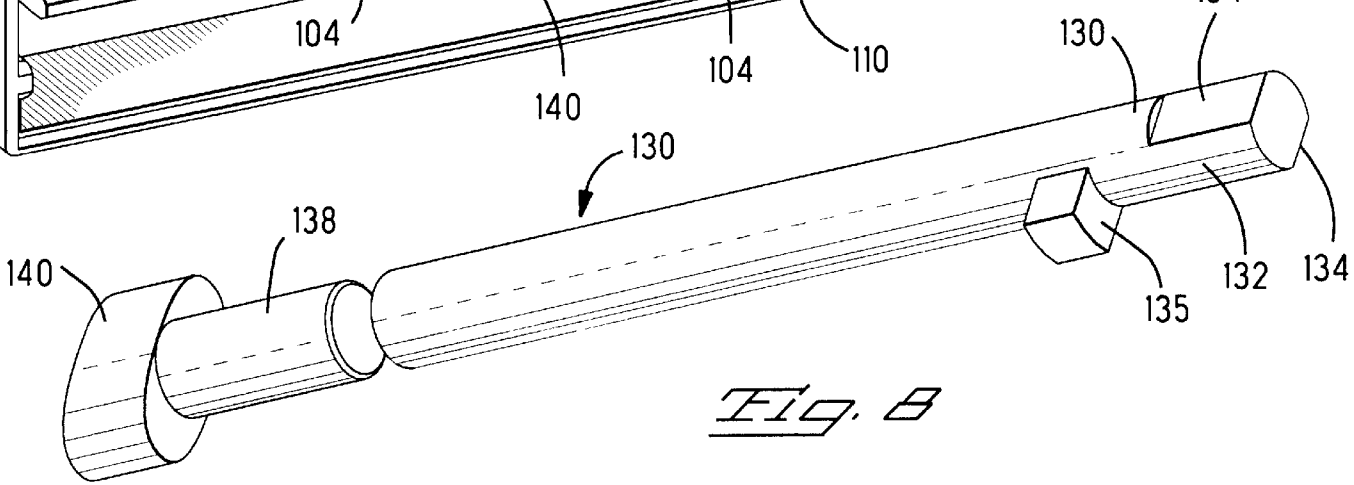
FIG. 8 is an isometric view of the rotating shaft.

The plug connector 100 has a channel 126 to receive a rotating shaft 130 therein, see FIG. 6. FIG. 8 shows an isometric view of the rotating shaft 130. The rotating shaft has an actuation end 132 which has two flat surfaces 134 to engage a knob 136 (see FIG. 9) on the cover 120. Tab 135 provides a stop to limit the amount of rotation of the rotating shaft 130 within the plug connector 100. The shaft 130 has a working end 138 which has an oval shaped protrusion 140 extending therefrom. The protrusion 140 is turned upon actuation of the rotating shaft 130. The working end 138 extends into the mating face 110 of the plug connector 100, as is shown in FIG. 7, between the two circuit boards 104.

Figure 10:
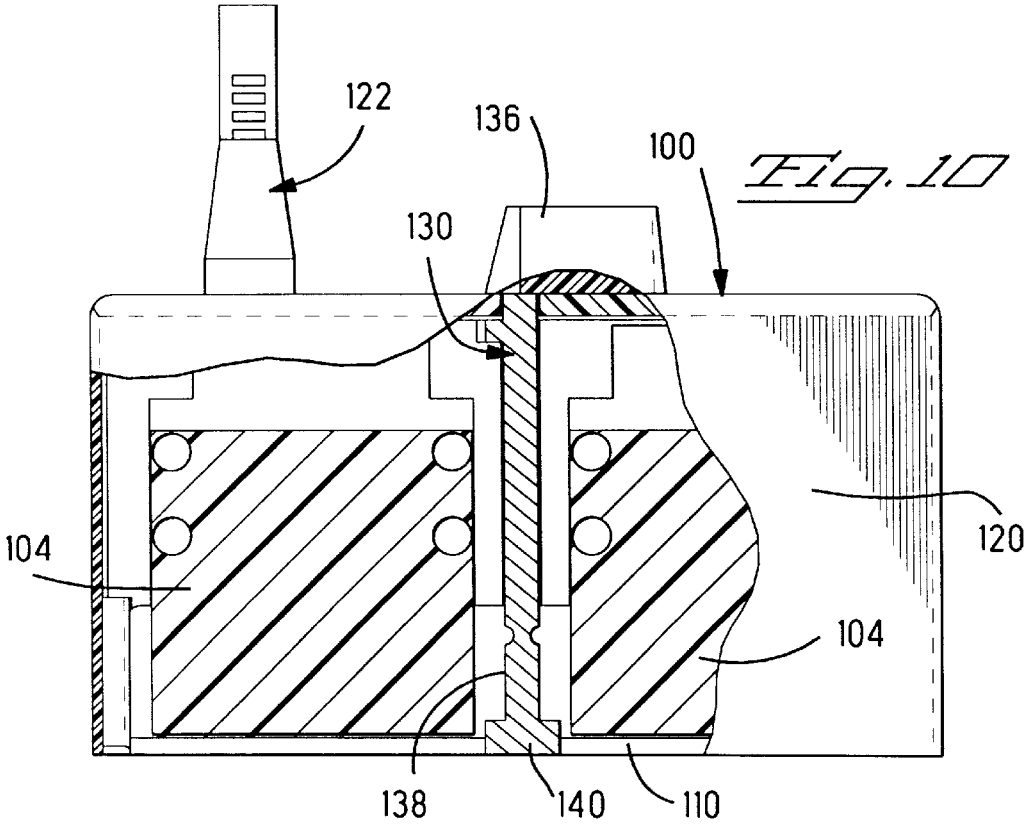
FIG. 10 is a partial cross sectional view of the plug housing.

FIG. 10 shows a partial cross sectional view of the assembled plug connector 100. The circuit boards 104 are mounted within the shells 102 and the rotating shaft 130 extends through the center of the shells 102. The strain relief 122 is aligned with the cable opening 112 to receive the cable therethrough. The cover 120 has a knob 136 which is secured over the actuating end 132 of the shaft 130 to allow easy rotation of the shaft 130 by the user.

Figure 9:
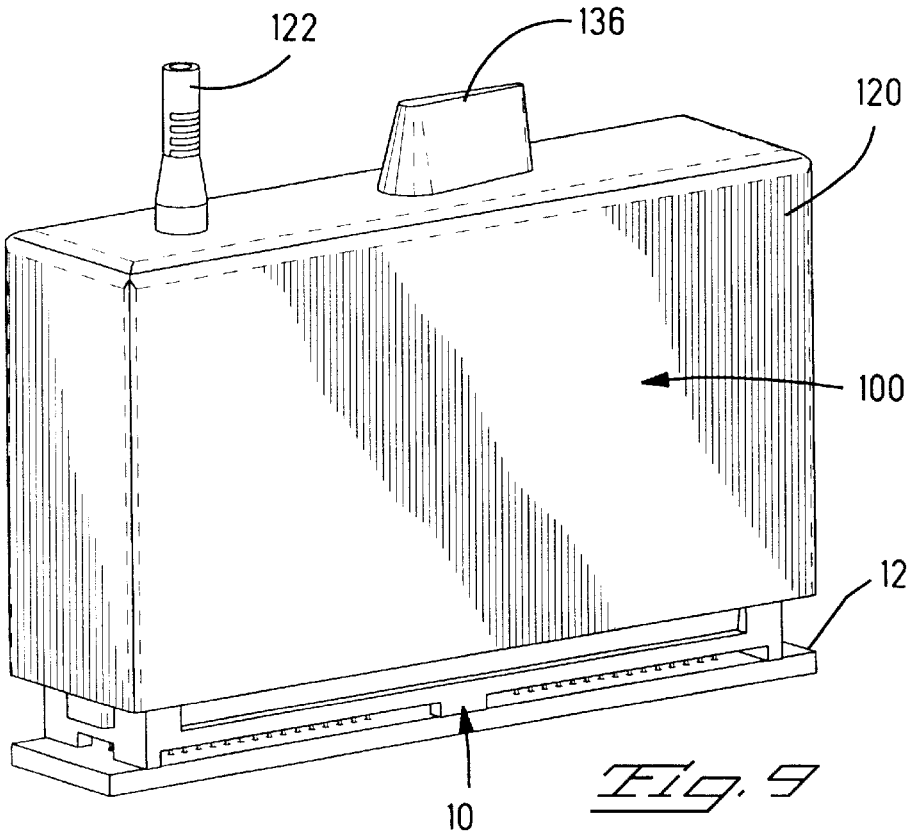
FIG. 9 is an isometric view of the plug housing mated with the receptacle housing.

FIG. 9 shows an isometric view of the plug housing 100 mated with the receptacle housing 10 which is mounted onto circuit board 12.

As was described earlier, the top of the contact housings 22 will be rotated outwardly prior to mating with the plug housing 100. When the plug housing 100 is mated with the receptacle housing 10, the circuit boards will be inserted between the contact housings 22, along the board receiving area 61. The slots 36, 38 serve to ensure that the circuit boards 104 are properly aligned within the receptacle housing 10 during mating of the connectors. The working end 138 of the rotating shaft 130 is received into recess 30 of the main housing 20.

Figure 11:
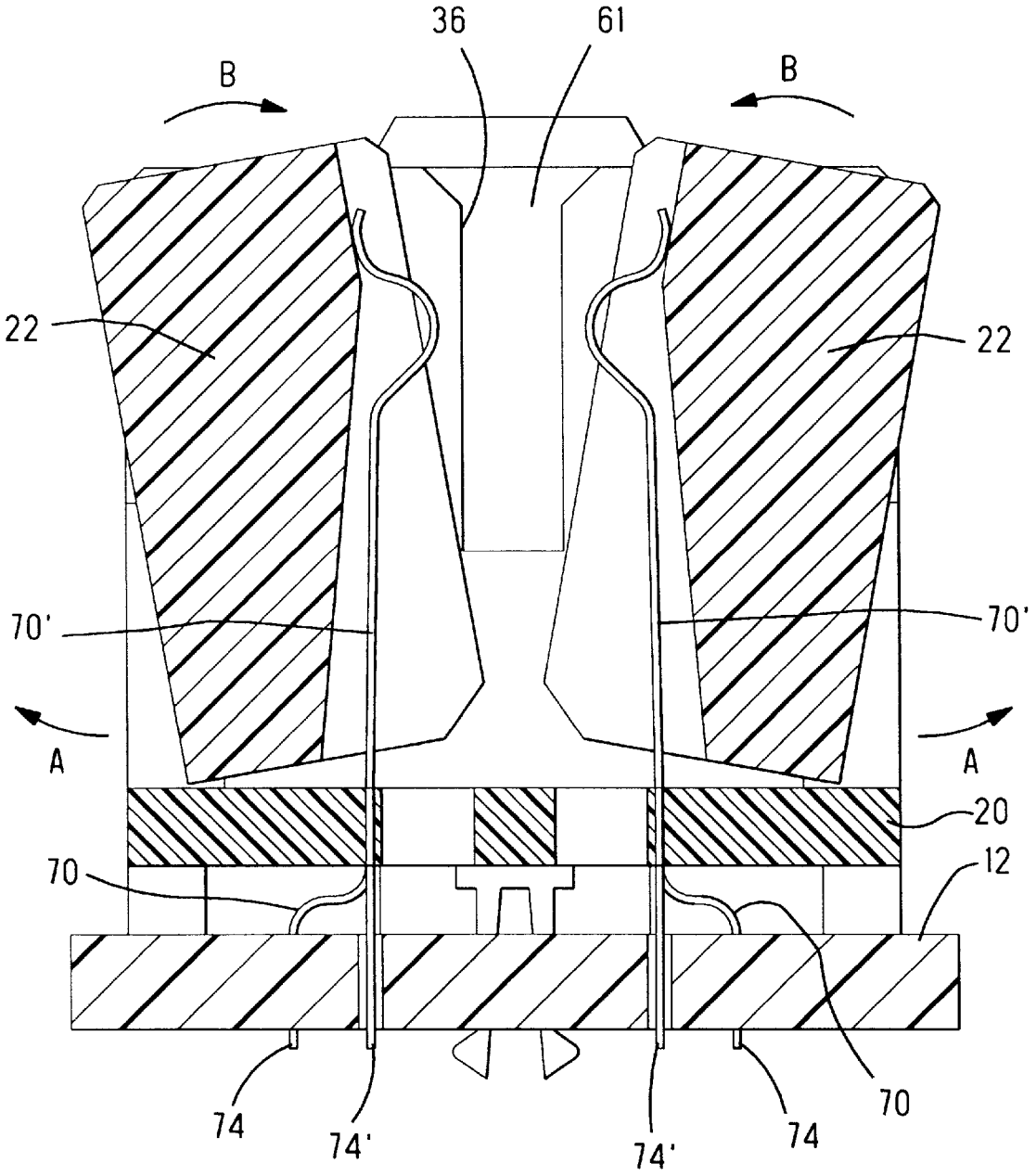
FIG. 11 is a cross sectional view of the receptacle housing with the contact housings in a first position.
Figure 12:
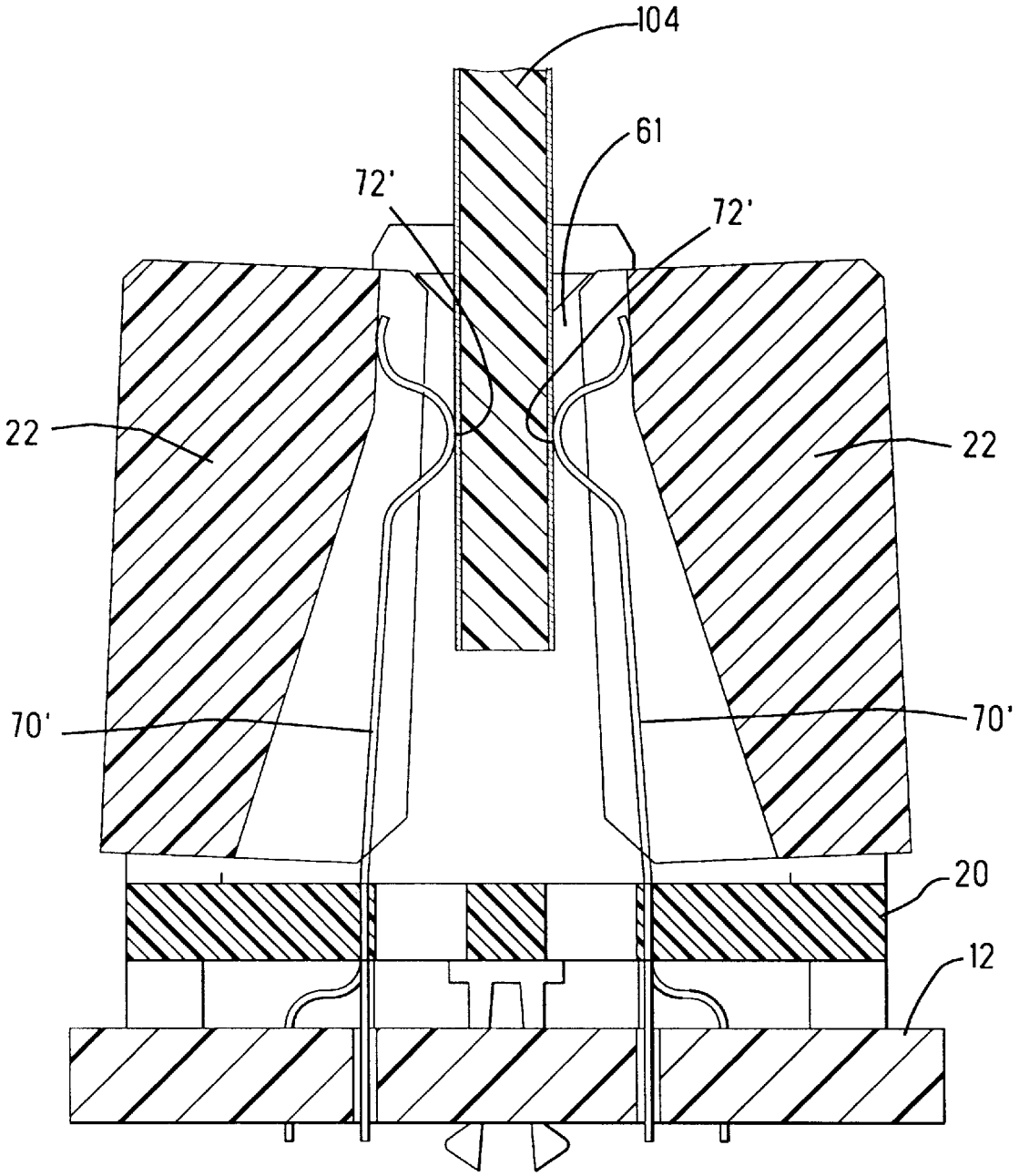
FIG. 12 is a cross sectional view of the receptacle housing mated with the plug housing with the contact housings in a second position.

FIG. 11 shows a cross sectional view of the receptacle connector 10 prior to mating with the plug connector. As can be seen in this view, the top portions of the contact housings 22 are rotated outwardly. During mating, the working end 138 of the shaft 130 is received within the opening 30 in the central portion 28 between the two contact housings 22. The oval protrusion 140 is received between the embossments 60 on the contact housings 22 so that the ends of the oval protrusion 140 are received against the contact housings 22. The circuit boards 104 are received within the slots 36, 38, and the board receiving area 61 as shown in FIG. 12. Upon actuation of the rotating shaft 130, the rounded ends of the oval protrusions 140 will engage and push on the embossments 60, thereby rotating the bottom portion of the contact housing 22 outwardly, as shown by arrow A, and rotating the top portion of the contact housing 22 inwardly, as shown by arrow B. Upon rotating the shaft 130 one quarter of a turn, the contacts 70, 70' will be pushed into contact with the contact pads 108 on the circuit boards 104 because of the rotation of the contact housing 22, thereby providing complete electrical connection between the receptacle connector 10 and the plug connector 100, as shown in FIG. 12.

FIG. 12 shows the contact housings 22 rotated inwardly so that the contacts 70, 70' engage the contact pads 108 on the board 104 within the plug connector 100.

Figure 13:
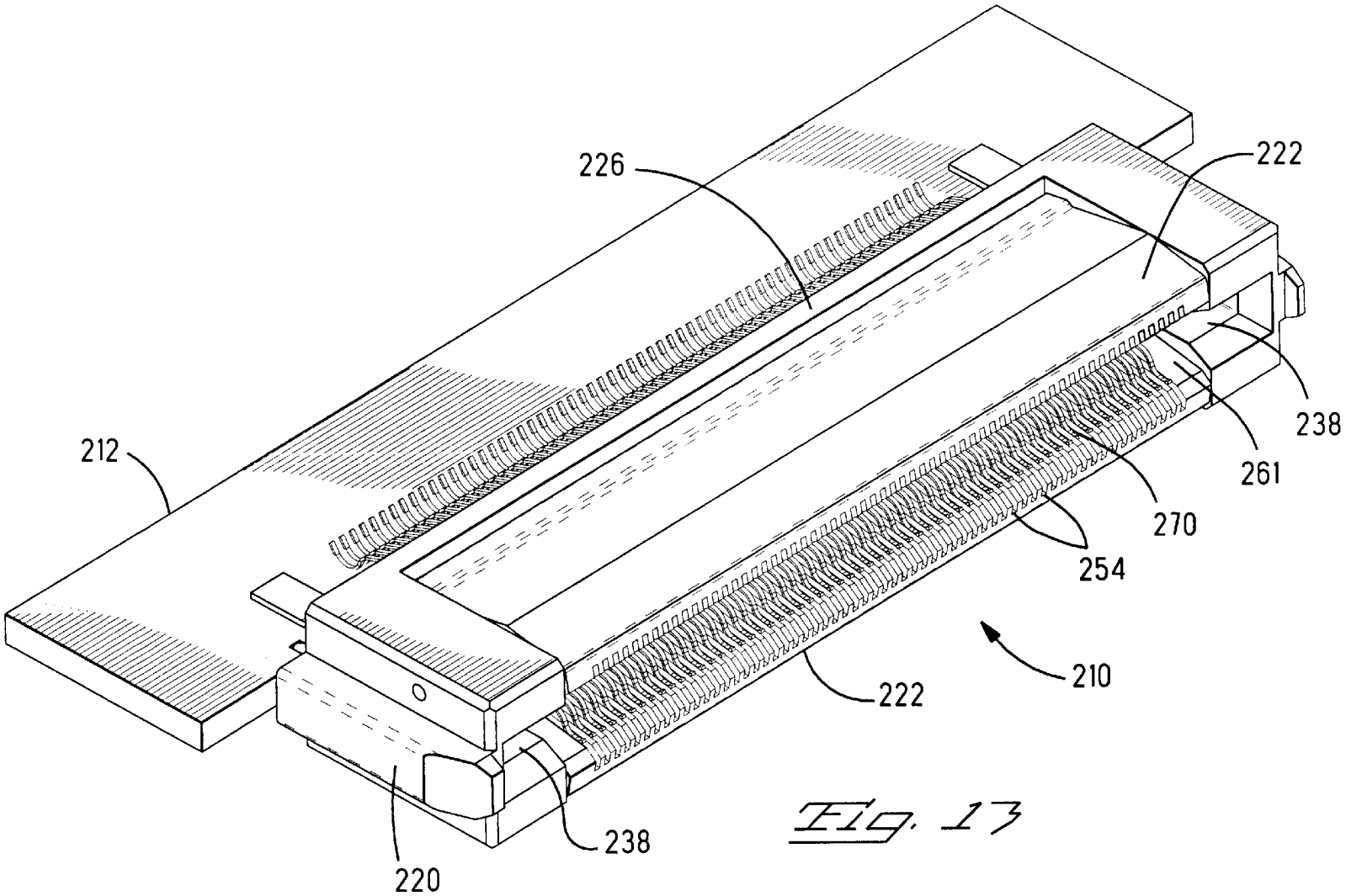
FIG. 13 is a an isometric view of an alternative embodiment of the receptacle connector.

FIG. 13 shows an alternative embodiment of the receptacle connector 210. The electrical connector 210 is mounted onto an edge of the circuit board 212. The electrical connector 210 has a main housing 220 and two hingeable contact housings 222 mounted along either side of the main housing 220. The main housing has two end walls 224 extending from a central base 226. Along inner edges of the end walls 224 are board receiving slots 238. Between the contact housings 222 is a board receiving area 261 into which a circuit board from the mating plug connector will be received. The receptacle connector 210 shown in FIG. 13 is designed to mate with only one circuit board therein, however, it is to be understood that the receptacle connector 210 could be designed to mate with two circuit boards and also the receptacle connector 10 could be designed to mate with one circuit board.

Figure 14:
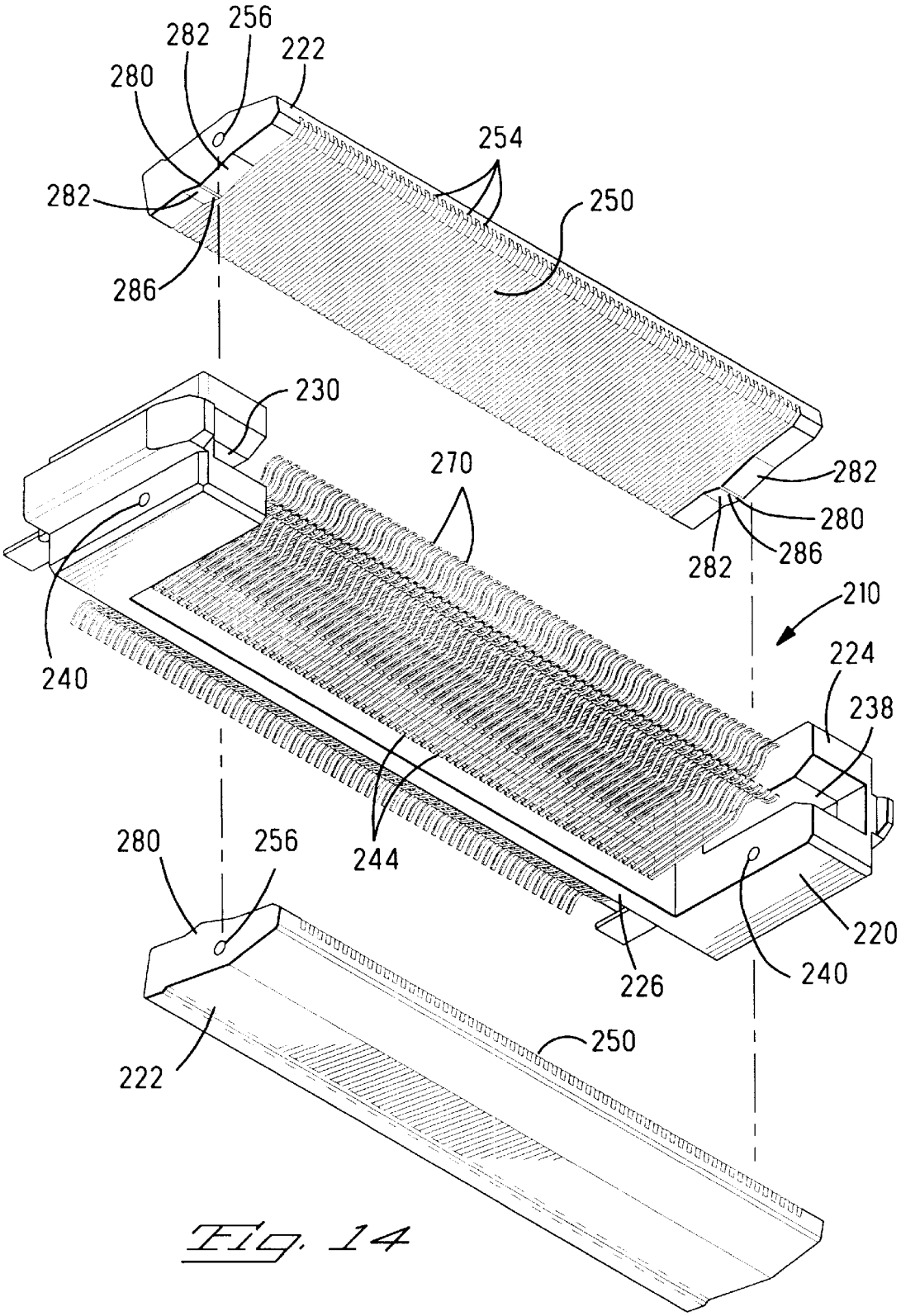
FIG. 14 is an exploded isometric view of the receptacle connector of FIG. 13.

FIG. 14 shows an exploded view of the receptacle connector 210. The contact housings 222 have contact receiving slots 254 disposed along a contact face 250. The contact housings 222 also have pin holes 256 which will receive hinge pins, not shown. Along the contact face 250 on either side of the contact receiving slots 254 are protrusions 280. The protrusions have two ramped surfaces 282 which lead to a point 286.

The receptacle connector 210 has a plurality of contacts 270 mounted therein. The contacts 270 have contact surfaces 272 and surface mount portions 272 which will be received against the circuit board 212. The contacts 270 are press fit into slots 244 within the main housing 220 and secured therein.

The main housing 220 has pin holes 240 which will align with the pin holes 256 on the contact housing 222 when the contact housing 222 is mounted to the main housing. When assembled, the contact housings 222 are received along the sides of the main housing 220 and pins are received through the pin holes 240 into the pin holes 256 to secure the contact housings 222 to pivot about the pins. The contacts 270 are secured in the main housing 220 and are aligned in the slots 254 along the contact housings 222.

The receptacle connector 210 will also include a board lock or board hold down which will secure the receptacle connector 210 to the edge of the circuit board 212. These board locks are well known and will not be further described here.

The receptacle connector 210 will mate with a mating plug connector, not shown, having a circuit board therein. The mating plug connector will be similar to the connector 110 shown in FIGS. 9 and 10, but it will not include the rotating shaft 130. It will have a circuit board exposed within the mating face for mating with and engaging the contacts 270.

Prior to mating with the mating plug connector, the contact housings 222 will be rotated outwardly, that is, the top portions of the contact housings 222 will be rotated away from each other, in a similar manner as was shown for receptacle connector 10. The contact housings 222 will be rotated outwardly because of the positioning of the contacts 270 within the contact housings 22. Upon mating of the receptacle connector 210 with the mating plug connector, the circuit board will be received within the board receiving slots 238 in order to properly align the circuit board within the receptacle connector 210. As the circuit board is received further within the receptacle connector 210, the leading edge of the circuit board will engage the ramped surface 282 of the protrusion 280. The force of the circuit board on the protrusion 280 will force the bottom portion of the contact housings 222 outwardly, thereby rotating the contact housings 222. The contact housings 222 will rotate around the hinge pins which are received within the pin holes 240, 256 thereby pushing the top portions of the contact housings 222 towards each other and towards the circuit board 212. Because of the rotation of the top portion of the contact housings 222, the contact surfaces 272 of the contacts 270 will be pushed into contact with the circuit board in the mating plug connector. Therefore, the receptacle connector 210 provides a zero insertion force mating against the circuit board because the contact housings 222, and therefore the contact surfaces 272, are rotated out of the way for the insertion of the circuit board. Once the circuit board in the mating connector is completely inserted within the receptacle connector 210, the contact surfaces 272 will be rotated until they are in electrical contact with the circuit board.

The plug and receptacle connectors of the present invention provide a zero insertion force connector for the inserting the circuit boards in the plug housing into the receptacle connectors. The contacts in the receptacle connectors are then brought into contact with the board after the two connectors are fully mated with each other.

The plug and receptacle connectors of the present invention and many of their attendant advantages will be understood from the foregoing description. It is apparent that various changes may be made in the form, construction, and arrangement of parts thereof, without departing from the spirit or scope of the invention or sacrificing all of its material advantages.

What is claimed is:

1. An electrical connector comprising:

a first housing to be mounted onto a circuit board, a contact housing being hingably mounted to the first housing, the contact housing having a plurality of contacts mounted therein, the contact housing and the contacts forming a board receiving area to receive a second circuit board therein, the contact housing being rotatable from a first position in which the contacts do not engage the second circuit board when it is received within the board receiving area and a second position in which the contacts engage the second circuit board when it is within the board receiving area, wherein the contact housing has an engagement area for engagement with the mating connector, whereby upon engagement with the mating connector, the contact housing is rotated from the first position to a second position.

2. An electrical connector assembly having a receptacle connector with a housing and a rotatable contact housing having a plurality of contacts mounted therein, the contact housing having a first position in which the contacts are out of engagement with a mating connector receiving area and a second position wherein the contacts are in engagement with the mating connector receiving area, the contact housing having a first engagement area for engagement with the mating connector, a mating plug connector having a circuit board to be receiving within the mating connector receiving area when mated with the receptacle connector, the plug housing having a second engagement area thereon, whereby, upon engagement with the mating connector, the contact housing is rotated from the first position to a second position.

3. An electrical connector assembly having a receptacle connector with a housing and a rotatable contact housing having a plurality of contacts mounted therein, the contact housing having a first position in which the contacts are out of engagement with a mating connector receiving area and a second position wherein the contacts are in engagement with the mating connector receiving area, the contact housing having a first engagement area comprising protrusions with ramped surfaces, a mating plug connector having a circuit board to be received within the mating connector receiving area when mated with the receptacle connector, the plug housing having a second engagement area comprising sides of the circuit board whereby upon engagement of the second engagement area on the plug connector with the first engagement area on the receptacle connector the sides of the circuit board engage the ramped surfaces thereby rotating the contact housing from the first position to the second position.

4. An electrical connector assembly comprising:

a receptacle connector with a housing and at least one rotatable contact housing having a plurality of contacts mounted therein, the at least one contact housing having a first position in which the contacts are out of engagement with a mating connector receiving area and a second position wherein the contacts are in engagement with the mating connector receiving area, the at least one contact housing having a first engagement area; and a mating plug connector having a housing with a second engagement area, said mating plug connector having at least one circuit board to be received within the mating connector receiving area when mated with the receptacle connector, at least one metal shell completely surrounding said housing and providing an inner cavity for said at least one circuit board, the mating plug connector housing having a second engagement area thereon, whereby upon engagement of the second engagement area on the mating plug connector with the first engagement area on the receptacle connector, the contact housing being moved from the first position to the second position.

5. The electrical connector assembly of claim 4, wherein said cavity of said at least one shell is filled with a sealing substance.

6. An electrical connector assembly comprising:

a receptacle connector with a housing and first and second contact housings responsive to an external device and each having a plurality of contacts mounted therein, the first and second contact housings each having a first position in which the contacts are out of engagement with a mating connector receiving area and a second position wherein the contacts are in engagement with the mating connector receiving area, the first and second contact housings each having a first engagement area;

a mating plug connector having a housing with a second engagement area, said mating plug connector providing connection between first and second circuit boards to be received within the mating connector receiving area of said housing when respectively mated with the plurality of contacts of said first and second housing of the receptacle connector; and a rotatable device serving as said external device to which said first and second contact housings are responsive, said rotatable device having means to simultaneously move each of said first and second contact housings from said first to said second positions.

* * * * *